US006446834B2

(12) United States Patent
Davis et al.

(10) Patent No.: US 6,446,834 B2
(45) Date of Patent: Sep. 10, 2002

(54) DISPENSING MEANS

(76) Inventors: Terrence Robert Davis, 18 Chesterton Close, Hunt End, Redditch, Worcestershire B97 5XS (GB); Joseph Eugene Holland, 838 Chester Road, Erdington, Birmingham B24 0EH (GB)

( * ) Notice: Subject to any disclaimer, the term of this patent is extended or adjusted under 35 U.S.C. 154(b) by 0 days.

(21) Appl. No.: 09/739,021

(22) Filed: Dec. 13, 2000

Related U.S. Application Data

(63) Continuation of application No. PCT/GB99/01909, filed on Jun. 15, 1999.

(30) Foreign Application Priority Data

Jun. 18, 1998 (GB) ..... 9813192

(51) Int. Cl.[7] ..... B67D 5/56
(52) U.S. Cl. ..... 222/52; 222/129.1; 137/100
(58) Field of Search ..... 222/52, 59, 14, 222/16, 71, 129.1; 137/625.3, 625.33, 625.37, 601.18, 12.5, 87.03, 100

(56) References Cited

U.S. PATENT DOCUMENTS

| | | | | |
|---|---|---|---|---|
| 2,516,825 | A | | 7/1950 | Hejduk et al. |
| 2,748,982 | A | | 5/1956 | Copping |
| 3,073,349 | A | | 1/1963 | Mitchell |
| 3,110,320 | A | | 11/1963 | Rosenberger |
| 3,695,290 | A | | 10/1972 | Evans |
| 3,851,668 | A | | 12/1974 | Benjamin |
| 3,955,794 | A | | 5/1976 | Hankosky |
| 4,108,134 | A | | 8/1978 | Malec |
| 4,795,131 | A | * | 1/1989 | Scarano et al. ..... 251/63 |
| 5,516,079 | A | * | 5/1996 | Baumann ..... 251/61 |
| 5,868,279 | A | * | 2/1999 | Powell ..... 222/59 |
| 5,950,870 | A | * | 9/1999 | Takenaka ..... 222/52 |
| 5,967,367 | A | * | 10/1999 | Orsborn ..... 222/30 |

FOREIGN PATENT DOCUMENTS

| | | |
|---|---|---|
| EP | 0 692 681 | 1/1996 |
| FR | 2 416 424 | 8/1979 |
| GB | 625685 | 7/1949 |
| GB | 634362 | 3/1950 |
| GB | 1 507 353 | 5/1975 |
| GB | 1 444 429 | 7/1976 |
| GB | 1 551 170 | 8/1979 |

* cited by examiner

*Primary Examiner*—Lesley D. Morris
*Assistant Examiner*—Patrick Buechner
(74) *Attorney, Agent, or Firm*—Sten Erik Hakanson

(57) ABSTRACT

A beverage dispense apparatus having one or more outlets for fluids to be dispensed, a fluid supply line for each fluid, each outlet being governed by a valve, and a valve actuator to open and close each valve. A flow sensor is positioned in each fluid supply line and connected to a control which controls the opening of its respective valve on receiving a start signal and actuates closing of the valve when the pre-determined amount of fluid flow has been achieved. Each valve includes a closure member movable in a passageway from a first position in which the valve is fully closed to a second position in which the valve is fully open. The closure member comprises a groove having a transverse cross section that increases in area in the downstream or upstream direction, whereby movement of the closure member from the first position towards the second position opens a flow channel through the groove.

6 Claims, 6 Drawing Sheets

DISPENSING MEANS

This application is a continuation of PCT/GB99/01909, filed Jun. 15, 1999.

This invention relates to dispensing means, particularly, but not exclusively, for beverages made by mixing beverage constituents. It has particular application in the field of soft drinks such as colas or flavoured sodas but it will be appreciated that it is not limited thereto.

Beverages may be dispensed, for example, using a dispense tower which is raised above a serving table level to provide beverage outlets through dispense valves located at or about shoulder height. The tower contains pipework for carrying the beverage ingredients and its outer surface frequently carries advertising material for the beverage(s) to be dispensed.

The tower may have multiple outlets at its upper end, the outlets forming a horizontal line of dispense valves. This permits more than one beverage to be dispensed simultaneously and it is possible to have a number of different beverages dispensable from a single tower.

In the case of beverages such as colas, the tower may carry pipework for chilled soda (carbonated water) and for a cola or other flavoured syrup. The separately supplied soda and syrup are then mixed together in the correct proportions at the outlet in a specially-designed dispense valve known as a post-mix dispense valve. A still water supply may also be required so that still beverages can be mixed and dispensed.

The present invention is applicable to such an arrangement but, again, is not limited thereto. Thus the apparatus of the invention may be applied to a series of separate dispense heads or to a single all-embracing dispense head.

The present invention aims to provide an improved mixing and dispensing means whereby the amount of each fluid to be dispensed can be accurately controlled.

Accordingly, the invention provides a beverage dispense apparatus comprising a dispense head having one or more outlets for fluids to be dispensed, a fluid supply line to the head for each fluid, each outlet being governed by a valve, a valve actuation means to open and close each valve, a flow sensor positioned in each fluid supply line and connected to a control means which controls the valve actuation means whereby it actuates opening of its respective valve on receiving a start signal and actuates closing of the valve when the pre-determined amount of fluid flow has been achieved, the valve of each outlet comprising a housing containing a passageway between an inlet and an outlet of the valve, a closure member movable in the passageway from a first position in which the valve is fully closed to a second position in which the valve is fully open, the closure member engaging the wall of the passageway to seal the passageway, the wall of the passageway and/or the closure member defining at least one groove, the groove having a transverse cross section that increases in area in the downstream or upstream direction, whereby movement of the closure member from the first position towards the second position opens a flow channel through the groove.

A start signal may conveniently be given by pressing an appropriately marked button on the dispense head for the desired beverage from the range of beverage options offered by the apparatus. The start signal activates the control means, which may conveniently be electronic.

Alternatively, each beverage option may have a code which is keyed into the apparatus to give the appropriate start signal.

The flow sensor may be of any convenient type. Thus, for example, it may be an ultra-sonic sensor or a flow sensing turbine of the types well-known in the art.

The valve actuation means may be, for example, a stepper motor, e.g. of the pulsed, magnetically driven type, a proportional solenoid actuator or the like. Alternatively the actuation means may be hydraulic, or pneumatic or any suitable combination e.g. electromechanical.

Thus the valves can be controlled to govern the proportions of fluids that are fed to and mixed at the head prior to dispense. Alternatively they can be controlled to provide a predetermined volume of a single fluid.

In addition to blending beverage constituents, e.g. to provide lower or higher carbonated colas, the apparatus may be used to blend warm and cold fluids together by the incorporation of a temperature sensor to give a mixed beverage of predetermined temperature.

As indicated above, the valves have a groove construction, i.e. the valve closure member and the wall of the passageway containing the valve closure member define between them one or more grooves, e.g. a pair of diametrically opposed grooves, the grooves extending and increasing or decreasing in cross-sectional area along the axial length of the passageway, whereby opening and closing of the valve exposes more or less of the groove volume to increase/decrease the volume of the passageway through the valve. The grooves may, for example, increase in cross-sectional area in the downstream direction.

The grooves may be of a "V" cross-section but other shapes, e.g. circular or rectangular cross-section may be utilised, if desired. For convenience, however, the grooves will hereafter be referred to as V-grooves.

The grooves may, for example, be cut or moulded into the material of the passageway wall or closure member by conventional means depending on the material used..

The grooves are preferably V-grooves that widen along their length at an angle of from 1° to 20°.

Where more than one groove is provided in the passageway, it is not essential that all the grooves are positioned to commence and finish at the same distance along the passageway.

The valve closure member may carry one or more sealing rings to engage the wall of the passageway in the first position, i.e. the closure member may engage the wall of the passageway by means of the sealing ring(s) to close the outlet or, alternatively, the closure member and passageway may be a precision fit in the first position to close the outlet without a seal.

As indicted above, depending on the desired particular construction, the V groove or grooves in the passageway may increase in cross-sectional area in the upstream or downstream direction. In the latter case, the valves have the added advantage of having greater self-cleaning properties, i.e. larger particles can pass more readily through the valve in the open position without causing partial blockage than for a conventional valve having an annular passageway of the same throughput.

Conveniently the passageway and closure member are of generally cylindrical transverse cross-section and a pair of grooves may be opposed diametrically across the passageway. However, it will be appreciated that the invention is not limited to such constructions.

The progressive increase or decrease in area of the V-groove flow channels can provide excellent linear flow through the valves.

Where the flow sensor is of the ultra-sonic type it may be of a construction generally known per se. Essentially, such a sensor comprises a piezo-electric crystal member which emits ultra-sonic pulses when an electrical signal is applied to it. The member can also receive ultrasonic pulses and produce an electrical output signal therefrom. A sensor is positioned at each end of a flow passage for the fluid and an ultra-sonic pulse is passed through the fluid from the upstream to the downstream sensor and then a pulse is passed through the fluid from the downstream sensor to the upstream sensor. Thus the signals are measured in two directions through the flowing fluid and the thus monitored flow is signalled to the electronic control unit. It will be appreciated that the signal flight time may vary with fluid density, viscosity and temperature and the control unit will be pre-programmed accordingly.

The piezo-electric sensors may conveniently each be designed as a unit to plug into a suitable housing in the wall at each end of the flow passage whereby they can pulse through the wall. Thus the sensor units may be removed without breaching the passageway.

Moreover, the flow passage may be angled e.g. may be L-shaped, with a reflector at the corner of the angled passage to reflect the ultrasonic signals around the bend of the angle. The angle may be, for example, about 90° but other angles may be utilised as convenient. This angling of the passage enables the sensor unit to be packaged into a smaller volume.

Embodiments of the invention will now be described by way of example only with reference to the accompanying drawings in which.

Figure 1:
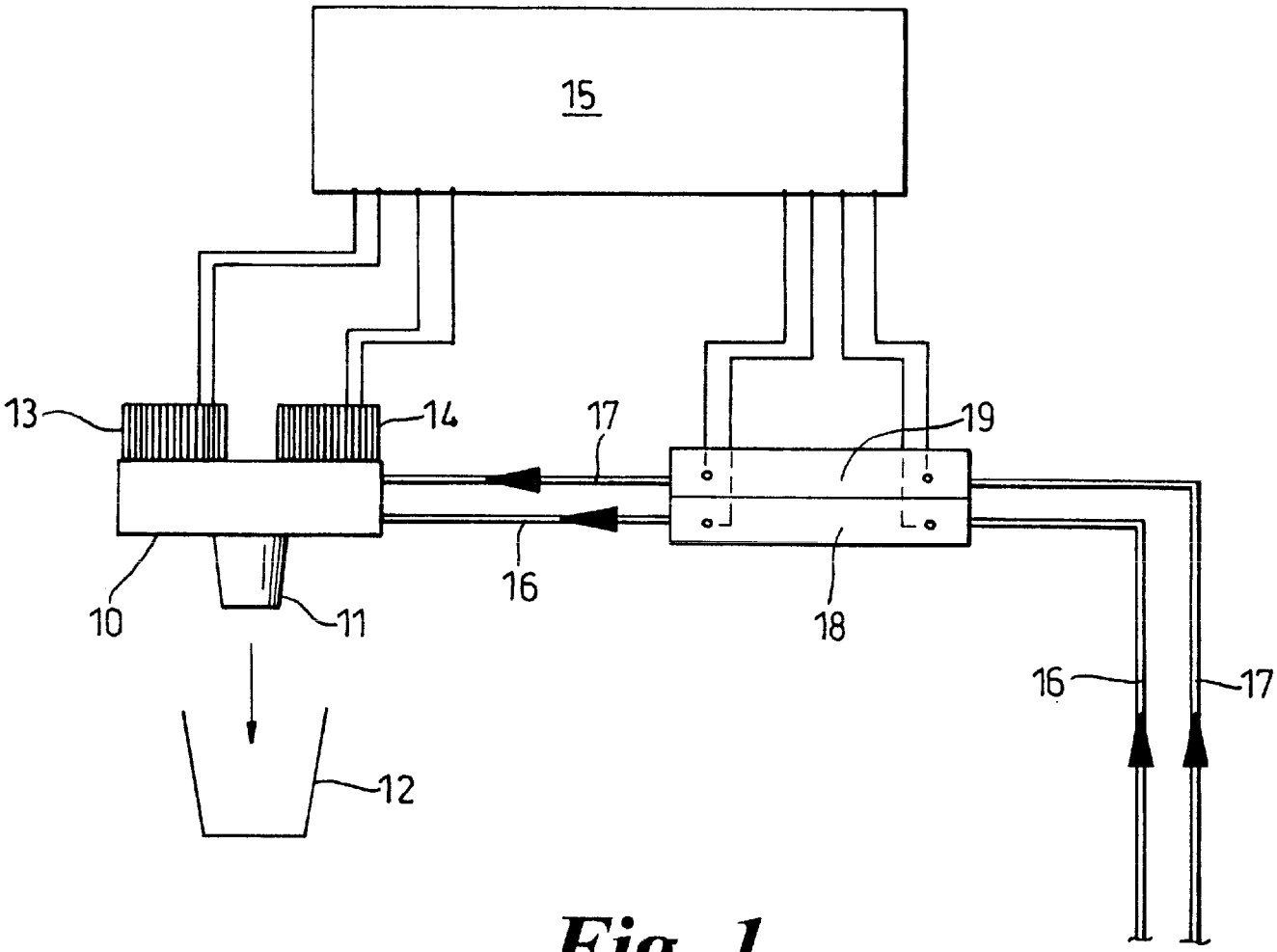
FIG. 1 is a diagrammatic representation of one form of apparatus according to the invention.

In FIG. 1 a dispense head 10 contains two control valves (not shown) to allow flow through outlet 11 of the head when a drink is dispensed into a cup 12. Each valve is actuated by a stepper motor 13, 14 respectively and the stepper motors are connected to and controlled by pre-programmed electronic control unit 15.

Two flow lines 16, 17 for different fluids are provided, flow being to the head 10. Each flow line 16, 17 passes through an ultra-sonic flow sensor 18, 19 respectively. Each sensor 18, 19 is connected to control unit 15 whereby the flow through each line 16, 17 is monitored.

On initiating the start signal, e.g. a button (not shown) on head 10, the control unit causes motors 13, 14 to open the valves and fluids e.g. carbonated water and a syrup respectively, flow through lines 16 and 17 to the head 10. The rate of flow in each line is monitored by sensors 18, 19 and when a pre-determined amount of each fluid has passed through the sensors the control unit actuates valves 13 and 14 to shut off flow. The fluids are mixed in head 10 and dispensed into cup 12.

Alternatively the start signal may activate flow in one only of the flow lines whereby a predetermined amount of a single fluid, e.g. carbonated or still water, is dispensed.

Figure 3:
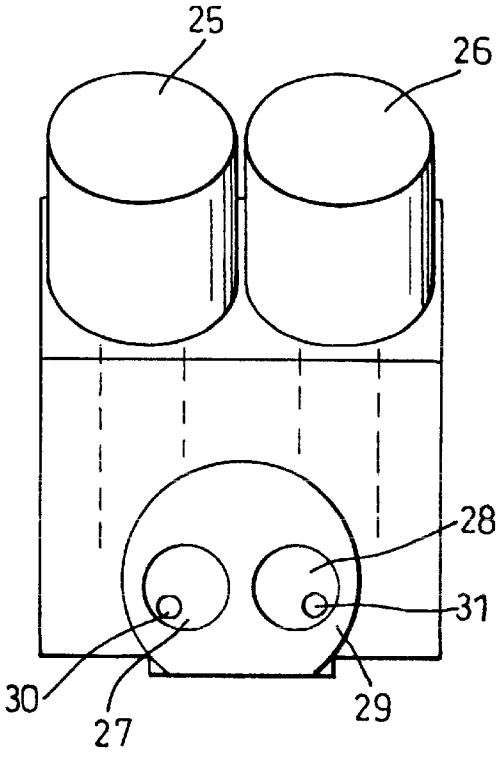
FIG. 3 is a view in the direction of arrow A of FIG. 2.
Figure 2:
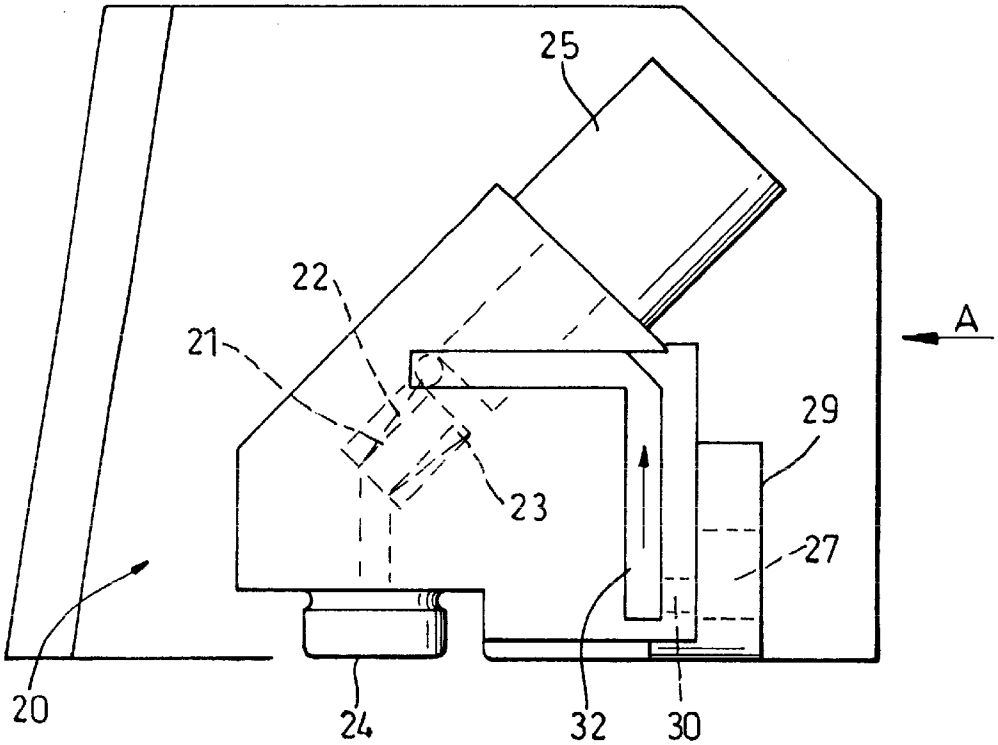
FIG. 2 is a representation in side view and part section of a dispense head for use in the invention.

In FIGS. 2 and 3 is shown a specific form of a head of the apparatus of the invention.

Head 20 again contains two control valves, one of which, valve 21 is shown. Each valve has a flow passageway defined by a pair of V-grooves 22, 23 in the passageway wall, the grooves being opposed diametrically across the passageway and tapering in the direction of flow which leads to an outlet 24.

The valves are actuated by a pair of stepper motors 25, 26, motor 25 actuating valve 21 and motor 26 actuating the unseen valve.

Two fluid passageways 27, 28 are provided, e.g. for carbonated and still water respectively, in a mounting block 29 for coupling to a source of the fluids. Within the head 20 passageways 27 and 28 lead to narrower drilled passages 30, 31 respectively. Each passage 30, 31 leads to an ultrasonic flow sensor, only one of which, sensor 32, is visible in FIG. 2.

Flow sensor 32 and the unseen sensor are L-shaped in construction for ease of fitment into head 20. However, it will be appreciated that they may, if desired, be linear and they may, if convenient, be fitted into their respective flow lines outside of the head.

The sensors and the stepper motors are connected to a pre-programmed electronic control unit (not shown) in the manner shown in FIG. 1 whereby actuation of the valves and flow of the fluids is controlled in a pre-determined manner.

Again, on actuating the start signal, one or the other valve is opened to dispense the chosen fluid or both valves may be opened to dispense a mixture of the fluids until the predetermined volume has been dispensed when the valve (or valves) is (are) closed.

Alternative valve arrangements will now be described with reference to FIGS. 4 to 9.

Figure 4:
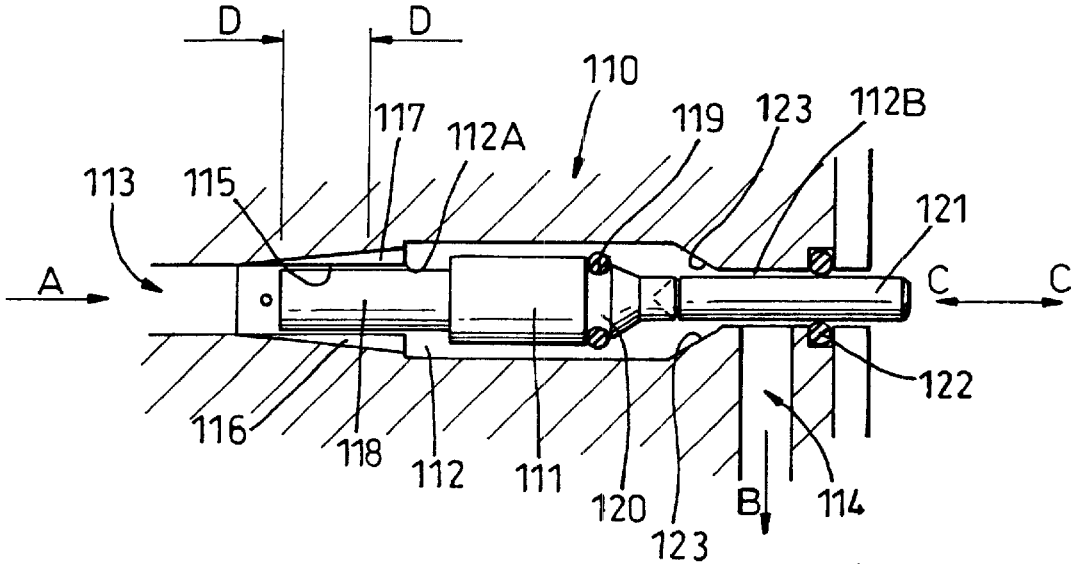
FIG. 4 is a diagrammatic illustration in part section of a first valve for use in the invention.

In FIG. 4, a valve 110 comprises a closure member in the form of a piston 111 in a passageway 112 leading from an inlet 113 to an outlet 114, the outlet extending at right angles to passageway 112. Fluid flow is in the direction of the arrows A and B (which direction will be similarly indicated in all the embodiments below.).

Wall 115 of the passageway 112A adjacent inlet 113 is of cylindrical cross-section but with a pair of grooves 116, 117 diametrically opposed across the passageway. The grooves are of generally V configuration and increase in cross-sectional area as they extend in the downstream direction. A narrower extension 118 of piston 111 is a close sliding fit in passageway 112A.

At its downstream end piston 111 carries a sealing ring 119 in an annular groove 120. Downstream of groove 120 piston 111 tapers to a narrower extension 121 which slides in a narrow extension 112B of passageway 112 and engages a sealing ring 122 in the wall of passageway 112B.

The wall of passageway 112 has a tapered section 123 leading to its narrower extension 112B and seal 119 of piston 111 engages section 123 to close outlet 114 which is downstream thereof.

Piston 111 is moved backwards and forwards in passageway 112 to open and close the valve by means of its extension 121 being attached to a stepper motor (not shown) or other suitable means. This movement is indicated by arrows C—C.

The V grooves enable precise control of fluid flow with the flow control band width being indicted between arrows D—D. It has a self-cleaning flow path through the increasing groove cross-section and is pressure closed, although spring-assistance may be provided, if desired.

It will be noted that the upstream end of extension 118 of piston 111 will be in the maximum flow position of the V grooves at the moment that seal 119 engages wall portion 123 and closes the outlet.

Figure 5:
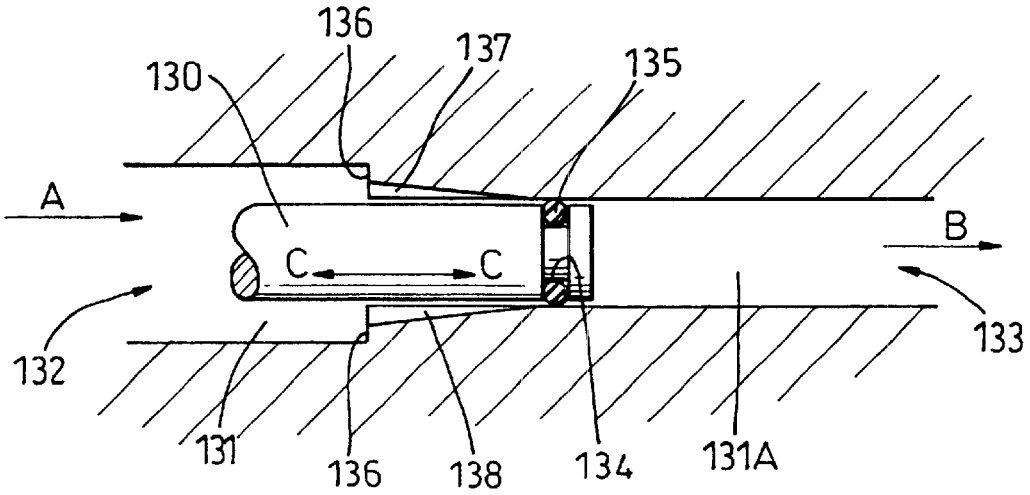
FIG. 5 is a similar illustration of a second valve for use in the invention.

In FIG. 5 valve closure member 130 is a cylindrical piston rod moveable backwards and forwards as indicated by arrows C—C in a passageway 131 between an inlet 132 and an outlet 133. Piston 130 is of constant diameter along its length and has an annular groove 134 containing a sealing ring 135 adjacent its downstream end.

Passageway 131 at inlet end 132 is of greater diameter than piston 130 and narrows via a stepped wall portion 136 to a narrower portion 131A in which piston 130 is a sliding fit and against the wall of which seal 135 seals in the closed position. A pair of diametrically opposed V grooves 137, 138 are provided in the wall defining narrower passage portion 131A, the grooves commencing at stepped wall portion 136 and narrowing in the downstream direction.

The upstream end of piston 130 is attached to a stepper motor (not shown) or other means to move the piston to open and close the valve.

The valve provides a gradual increase/decrease in pressure/flow on opening and closing. This construction provides minimal pressure on the seal in the closed position and low torque on the, e.g., stepper motor. There is no end stop load on the motor on closing the valve.

Figure 6:
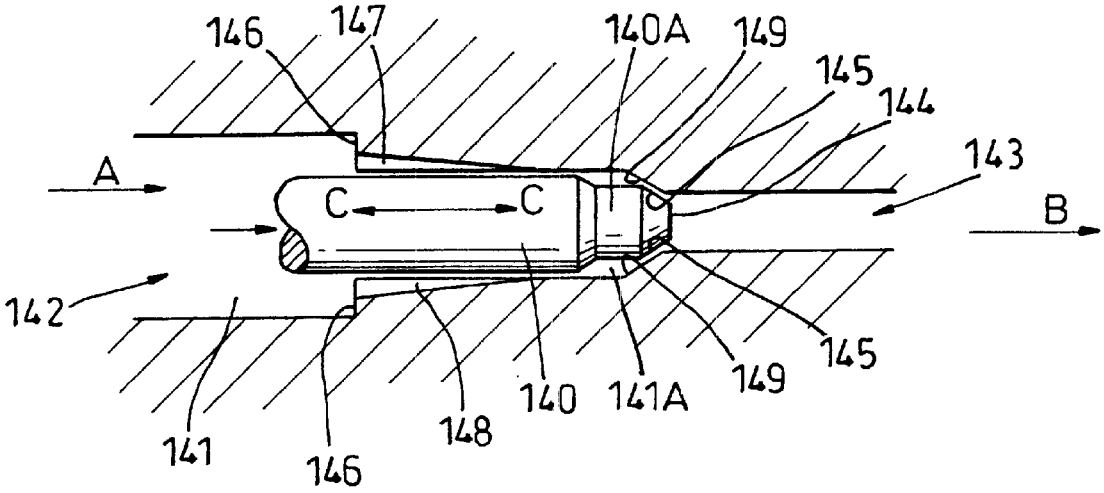
FIG. 6 is a similar view of a third valve for use in the invention.

In FIG. 6, the valve closure member is a piston rod 140 of cylindrical configuration movable backwards and forwards as indicated by arrows C—C in a passageway 141 between an inlet 142 and an outlet 143. Piston 140 tapers to a narrower nose 140A at its downstream end and nose 140A itself tapers at its downstream end to a flat end surface 144. The tapering portion 145 of the nose leading to the end surface 144 provides the sealing means to close the outlet as is described below.

As with the valve of FIG. 5, passageway 141 at its inlet end is of greater diameter than piston 140 and narrows via a stepped wall portion 146 to a narrow portion 141A in which piston 140 is a sliding fit. A pair of diametrically-opposed V grooves 147, 148 are provided in the wall defining narrower passage portion 141A, the grooves commencing at stepped wall portion 146 and narrowing in the downstream direction.

The upstream end of piston 140 is attached to a stepper motor (not shown) or other means to move the piston to open and close the valve, opening of the valve allowing flow through grooves 147 and 148.

Passageway portion 141A narrows at its downstream end by means of a tapered wall portion 149 and leads thereby to narrower outlet 143. Tapered wall portion 149 and tapered portion 145 of the nose of piston 140 are a mating, close tolerance fit in the closed position of the valve, whereby the outlet is closed without need for a separate sealing ring.

Thus this construction has no sealing ring to wear and provides a gradual increase/decrease of pressure/flow on opening and closing of the valve.

Figure 7:
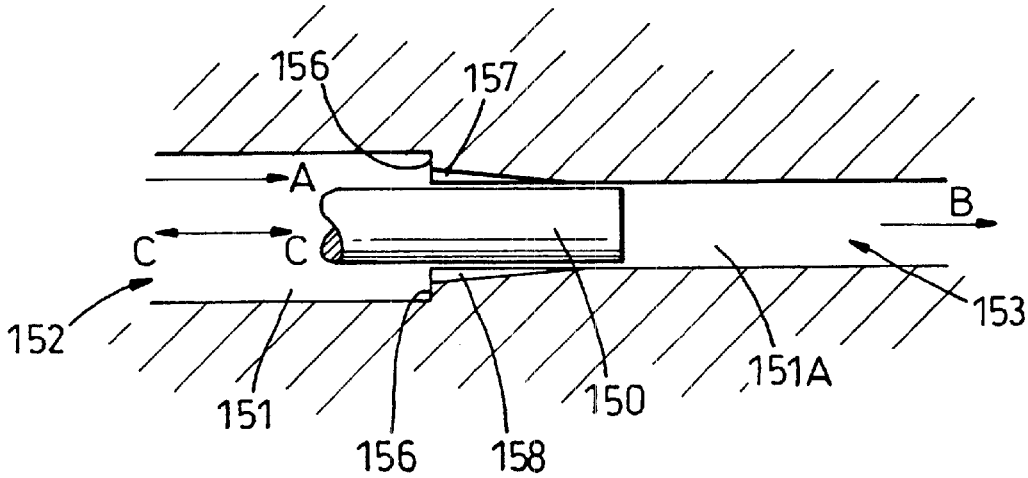
FIG. 7 is a similar view of a fourth valve for use in the invention.

In FIG. 7 is illustrated another valve that does not require a separate sealing ring. The valve closure member is a cylindrical piston 150 movable backwards and forwards as indicated by arrows C—C in a passageway 151 between an inlet 152 and an outlet 153.

Again passageway 151 at its inlet end is of greater diameter than piston 150 and narrows via a stepped wall portion 156 to a narrower portion 151A in which piston 150 is a sealing fit. Thus piston 150 is a precision fit into a bore of passageway portion 151A.

A pair of diametrically opposed V grooves 157, 158 is provided in the wall defining narrower passage portion 151A, the grooves again commencing at stepped wall portion 156 and narrowing in the downstream direction.

Again, the upstream end of piston 150 is attached to a stepper motor (not shown) or other means to move the piston to open and close the valve, opening of the valve allowing flow through grooves 157 and 158.

As with the FIG. 6 construction, this valve may be "seal-less". It also provides a gradual increase/decrease of pressure/flow on opening and closing, puts minimal pressure on the sealing surfaces when closed and low torque on the motor and has no end stop loading on the motor.

Figure 8:
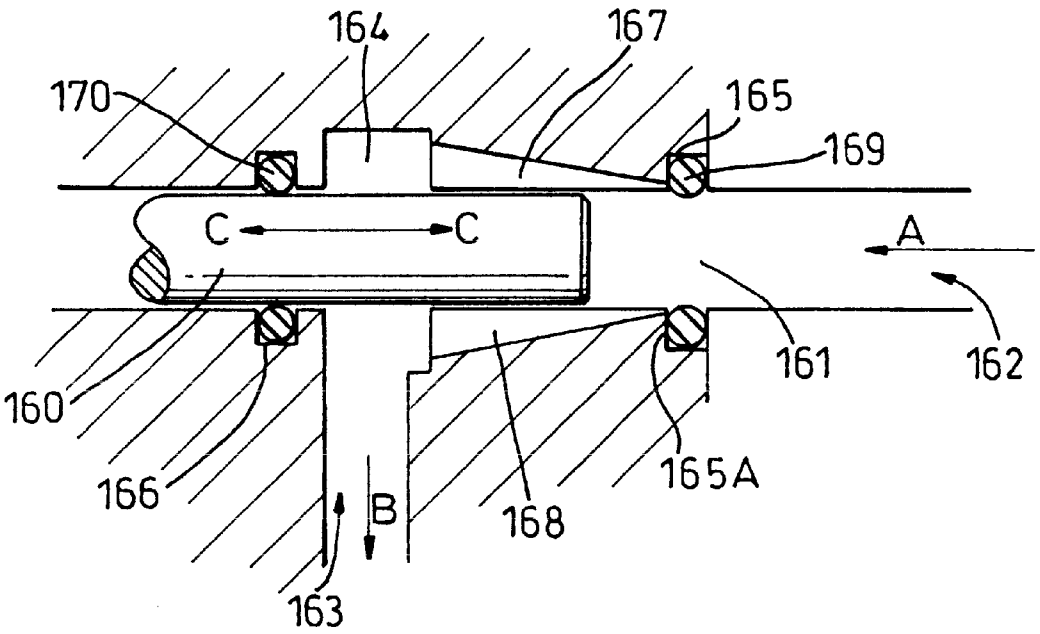
FIG. 8 is a similar view of a fifth valve for use in the invention.

In FIG. 8, the closure member is a cylindrical piston 160 movable backwards and forwards (in the direction C—C) in a passageway 161 between an inlet 162 and an outlet 163 which leads off at right angles from passageway 161 partway along the length of the piston.

The wall defining passageway 161 has a pair of diametrically-opposed V grooves 167, 168 between the inlet and an annular chamber 164 from which outlet 163 leads off. The grooves widen in the downstream direction to be at their widest as they reach chamber 164, which chamber forms part of and lies centrally of passageway 161.

The walls of passageway 161 define a pair of annular recesses 165, 166, each recess carrying a sealing ring 169, 170, respectively.

Figure 9:
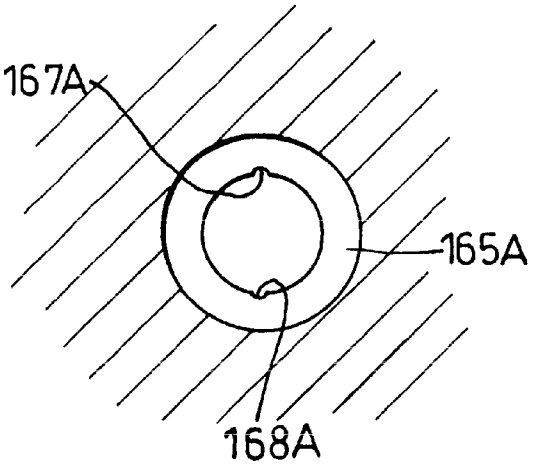
FIG. 9 is a view in the direction of arrow A of FIG. 8.

Recess 165 and its sealing ring 169 lie at the upstream end of V section grooves 167, 168, and piston 160 seals against ring 169 in the valve closed position. The seal 169 and the grooves 167 and 168 are so positioned that the upstream end of each V groove commences just downstream of the seal to prevent hydraulic lock occurring on the valve closing. As can be seen in FIG. 9, from which the seal 169 has been removed for clarity, the upstream ends 167A, 168A of grooves 167 and 168 just extend to breakthrough the downstream wall 165A of recess 165.

Recess 166 and its sealing ring 170 are positioned in passageway 161 beyond chamber 164 and outlet 163 and the piston 160 is a sliding sealing fit in ring 170 as it moves to open and close the valve.

Again, this construction provides gradual opening and closing of the valve, the sealing rings are subjected to little wear and the V grooves are self-cleaning in the flow direction shown.

All the above valves of FIGS. 4 to 9 provide a combined flow control and cut off means in a small compact unit.

The flow direction may, if desired be reversed in each of the above five valve embodiments but it will be appreciated that the improved self-cleaning effect will be achieved only where the V grooves broaden in the direction of flow.

Figure 10:
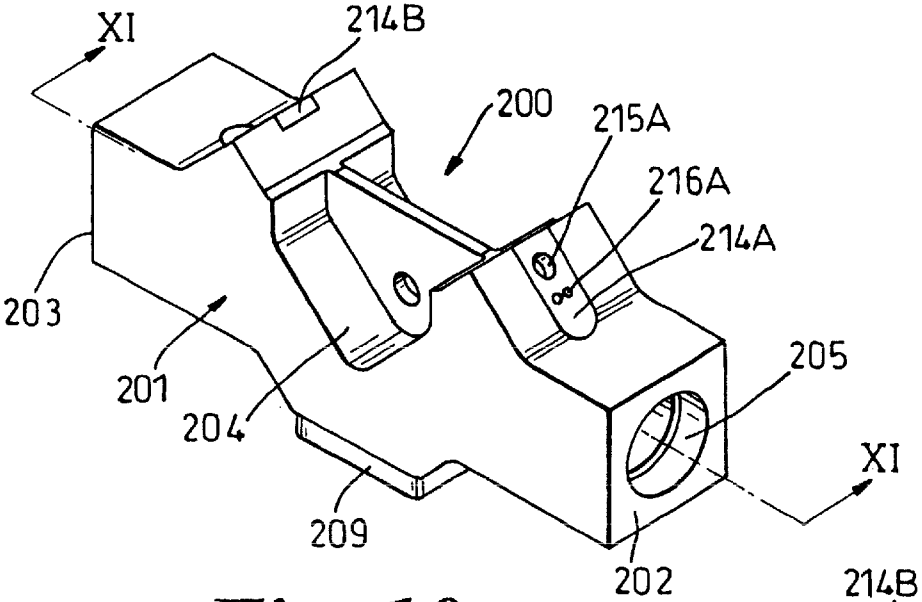
FIG. 10 is a perspective view of one form of ultra-sonic sensor suitable for use in the invention.

In FIG. 10 is shown in more detail an ultra-sonic flow sensor arrangement for use in the invention.

Figure 11:
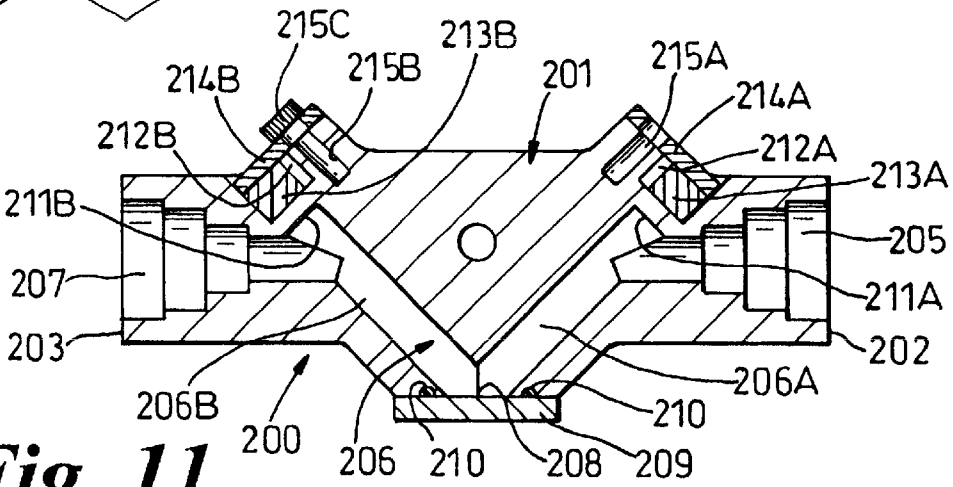
FIG. 11 is a section on line XI—XI of the sensor of FIG. 10.

In FIGS. 10 and 11 a sensor 200 comprises an elongated moulded plastics housing 201 having an inlet end 202 and an outlet end 203 with a V-shaped intermediate portion 204 between the inlet end and the outlet end. (It will be appreciated that fluid flow may be in either direction through the housing so that inlet .202 may become the outlet and outlet 203 may become the inlet.).

A through passageway for fluid extends from inlet end 202 to outlet end 203 and comprises a longitudinally-extending inlet passageway portion 205, a V-shaped intermediate passageway portion 206, having arms 206A, 206B and a longitudinally-extending outlet passageway portion 207. As shown, the inlet and outlet passageway portions 205, 207 are stepped so that each passageway narrows from the outside of the housing to the intermediate passageway portion 206. The apex 208 of the V-shaped passageway portion 206 is at the base of the housing 201 and is defined by a hole in the base of the housing, the hole being closed by a reflector plate 209. Plate 209, which may be of stainless steel, is screwed to the base of the housing 201 by screws (not shown) and is sealed to the base of the housing 201 around the hole in the base by a suitable gasket 210.

At the upper end of each arm 206A, 206B is wall 211A, 211B of the housing. On the opposite side of each wall 211A, 211B is a recess 212A, 212B in the exterior surface of the housing. Each recess 212A, 212B can contain a piezo-electric crystal sensor unit 213A, 213B respectively. Each unit 213A, 213B is held in place in its recess by a clamping plate 214A, 214B respectively and each clamping plate can be screwed to the housing 201 via screw holes 215A, 215B respectively. One screw 215C is shown in hole 215B. A suitable packing compound (not shown) may be placed in the recesses 212A, 212B prior to fitting units 213A, 213B therein to ensure the units are held in place without voids between them and their respective walls 211A, 211B. Electrical contact to the sensor units is made via electrical sockets 216A, through the clamping plate 214A and similarly, but not shown, through plate 214B.

When the piezo-electric sensor units are activated as fluid flows through the housing, their ultra-sonic pulses pass through wall 211A or 211B and then through the fluid along passageway portion 206A or 206B, strike reflector plate 209 and are reflected along passageway portion 206A or 206B to be received by the other sensor unit. Thus when sensor 200 is used in an apparatus as described, for example, with reference to FIGS. 1 to 3 above, the pulses are timed in two directions, with and against the flow, and the thus monitored flow is signalled to a control unit.

The V-shaped central portion of the through passageway enables the sensor housing to be reduced in overall size so that it can be more readily packaged into a beverage dispense system.

Moreover, as the piezo-electric crystal units are separated from the fluid flow passageways by walls 211A, 211B, the sensor units do not come into direct contact with the fluid. Hence the sensor units 213A, 213B can be removed for replacement or repair without breaching the fluid passageway and, hence, it is not necessary to close down or depressurise the fluid system for this purpose.

The invention enables very accurately metered beverages to be dispensed at the correct rate and in correct proportions. It can equally be used for portion control or free flow dispense.

What is claimed is:

1. A dispense apparatus for dispensing there from a diluent liquid and a concentrate liquid a desired ratio, comprising:

a dispense valve body having a diluent inlet and a diluent outlet and a fluid passageway there between and a concentrate inlet and a concentrate outlet and a fluid passageway there between so that diluent and concentrate flow in a downstream direction from their respective inlets to their respective outlets, a v-groove regulator in each passageway having a central orifice, the central orifice having sidewalls and the sidewalls each having at least one tapered groove therein and each groove increasing in cross-sectional area in a direction opposite to the of flow of diluent or concentrate there through, a first rod extending through the v-groove regulator in the diluent passageway and having a rod end moveable by a first linear actuator to a fully extended closed position and a fully retracted open position and to a plurality of positions there between for regulating the cross-sectional area of the one or more tapered grooves through which the diluent can flow for regulating the flow rate thereof, a second rod extending through the v-groove regulator in the concentrate passageway and having a rod end moveable by a first linear actuator to a fully extended closed position and a fully retracted open position and to a plurality of positions there between for regulating the cross-sectional area of the one or more tapered grooves through which the concentrate can flow for regulating the flow rate thereof, a diluent flow rate sensing means for sensing the flow rate of the diluent and a concentrate flow rate sensing means for sensing the flow rate of the concentrate and both flow rate sensing means connected to a control means for inputting thereto flow sensing data, and the control means for controlling the operation of the first and second linear actuators for regulating the flow of the diluent and concentrate in response to the input flow sensing data.

2. The apparatus as defined in claim 1, and each flow sensor comprising an ultrasonic sensor.

3. The apparatus as defined in claim 1, and each flow sensor comprising a pair of piezo-electric signal generating sensors units one of each pair placed in an upstream position in each of the fluid passageways and the other of the pair in a downstream position of each fluid passageway whereby separate ultrasonic pulses can be passed through the diluent fluid and through the concentrate fluid in one direction and then in a direction opposite thereto, and the piezo-electric sensor pairs connected to the control for inputting data thereto relative to time required for each pulse to travel between the sensor pairs so that the control can calculate the flow rate of the diluent and concentrate fluids.

4. A dispense apparatus for dispensing there from a diluent liquid and a concentrate liquid a desired ratio, comprising:

a dispense valve body having a diluent inlet and a diluent outlet and a fluid passageway there between and a concentrate inlet and a concentrate outlet and a fluid passageway there between so that diluent and concentrate flow from their respective inlets in a downstream to their respective outlets, a v-groove regulator in each passageway having a central orifice, the central orifice having sidewalls and the sidewalls each having at least one tapered groove therein and each groove decreasing in cross-sectional area in a direction opposite to the of flow of diluent or concentrate there through, a first rod extending through the v-groove regulator in the diluent passageway and having a rod end moveable by a first linear actuator to a fully extended closed position and a fully retracted open position and to a plurality of positions there between for regulating the cross-sectional area of the one or more tapered grooves through which the diluent can flow for regulating the flow rate thereof, a second rod extending through the v-groove regulator in the concentrate passageway and having a rod end moveable by a first linear actuator to a fully extended closed position and a fully retracted open position and to a plurality of positions there between for regulating the cross-sectional area of the one or more tapered grooves through which the concentrate can flow for regulating the flow rate thereof, a diluent flow rate sensing means for sensing the flow rate of the diluent and a concentrate flow rate sensing means for sensing the flow rate of the concentrate and both flow rate sensing means connected to a control means for inputting thereto flow sensing data, and the control means for controlling the operation of the first and second linear actuators for regulating the flow of the diluent and concentrate in response to the input flow sensing data.

5. The apparatus as defined in claim 4, and each flow sensor comprising an ultrasonic sensor.

6. The apparatus as defined in claim 4, and each flow sensor comprising a pair of piezo-electric signal generating sensors units one of each pair placed in an upstream position in each of the fluid passageways and the other of the pair in a downstream position of each fluid passageway whereby separate ultrasonic pulses can be passed through the diluent fluid and through the concentrate fluid in one direction and then in a direction opposite thereto, and the piezo-electric sensor pairs connected to the control for inputting data thereto relative to time required for each pulse to travel between the sensor pairs so that the control can calculate the flow rate of the diluent and concentrate fluids.

* * * * *